US008905903B2

(12) United States Patent
Hao

(10) Patent No.: US 8,905,903 B2
(45) Date of Patent: Dec. 9, 2014

(54) PULLING ROPE FIXING STRUCTURE

(75) Inventor: Szu-Chia Hao, Taipei (TW)

(73) Assignee: Plus 'O'Minus Fitness Products (Suzhou) Co., Ltd., Jiang Su Province (CN)

( * ) Notice: Subject to any disclaimer, the term of this patent is extended or adjusted under 35 U.S.C. 154(b) by 379 days.

(21) Appl. No.: 13/528,815

(22) Filed: Jun. 20, 2012

(65) Prior Publication Data

US 2013/0345029 A1 Dec. 26, 2013

(51) Int. Cl.
*A63B 21/00* (2006.01)

(52) U.S. Cl.
USPC ..... 482/126; 482/121

(58) Field of Classification Search
USPC ..... 482/121, 126, 125, 131, 138, 139, 142
See application file for complete search history.

(56) References Cited

U.S. PATENT DOCUMENTS

| | | | | |
|---|---|---|---|---|
| 5,800,322 | A * | 9/1998 | Block | 482/126 |
| 2007/0155600 | A1* | 7/2007 | Cunningham et al. | 482/126 |
| 2007/0207904 | A1* | 9/2007 | Wu | 482/126 |
| 2014/0221177 | A1* | 8/2014 | Reed et al. | 482/126 |

* cited by examiner

*Primary Examiner* — Jerome W Donnelly
(74) *Attorney, Agent, or Firm* — Leong C. Lei

(57) ABSTRACT

A pulling rope fixing structure includes a handle, a grip rope, a fixing device, an elastic element and a pulling rope. The handle is a hollow tubular body with the grip rope passed through the handle; the grip rope has first and second ends with first and second openings respectively; the fixing device includes a retaining ring and a fastening element, and the fastening element has a hollow sleeve passed into the first and second openings and operated with the retaining ring to fix the grip rope. The elastic element is installed in the hollow sleeve and has a penetrating hole for passing the pulling rope and separating the pulling rope from the fixing device. The pulling rope not in a direct contact with the metal fixing device will not be worn directly during exercises, and the service life of the pulling rope can be extended effectively.

10 Claims, 5 Drawing Sheets

PULLING ROPE FIXING STRUCTURE

BACKGROUND OF THE INVENTION

1. Field of the Invention

The present invention relates to an elastic fitness pulling rope structure, in particular to the pulling rope fixing structure capable of preventing damages caused by long-term contact and friction between a pulling rope and a fixing device installed onto the pulling rope.

2. Description of the Related Art

As our life becomes busier day after day, the time we spend on exercises becomes less and less. Since we live in an environment crowded with tall buildings, there is very little space left for exercises. To let people enjoy the fun of exercises in such environment, portable fitness equipments capable of maximizing the utility of space and time such as treadmills, steppers and elastic fitness devices are introduced.

With reference to FIG. 1 for a schematic view of a conventional elastic fitness device 1, the elastic fitness device 1 comprises a pulling rope 10, two handles 11, two strips 12 and two fixing elements 13, wherein each strip 12 is passed through the respective handle 11 and extended out from both ends of the handle 11; the fixing element 13 is provided for fixing and connecting both ends of the strip 12; and the pulling rope 10 is installed to the fixing element 13 and has an abutting portion 101 abutting the fixing element 13 to prevent the pulling rope 10 from being separated from the fixing element 13. When use, a user holds the two handles 11 and applies a force to the pulling rope 10, while overcoming the elastic force of the pulling rope 10 to achieve an in-situ exercise effect.

However, the aforementioned method of fixing the pulling rope 10 may break the pulling rope 10 at its contact point with the fixing element 13 by a fatigue wear, and users may be injured by the damaged pulling rope 10 during exercise.

In view of the foregoing problem, the inventor of the present invention developed a pulling rope fixing structure with the effects of preventing the pulling rope and the fixing device from rubbing with each other, preventing damages caused by frictions produced between the pulling rope and the fixing device, and extending the service life of the pulling rope, so as to overcome the foregoing problem of the prior art.

SUMMARY OF THE INVENTION

Therefore, it is a primary objective of the present invention to provide a pulling rope fixing structure capable of reducing frictional damages between the pulling rope and the fixing device to extend the service life of the pulling rope and prevent users from being injured by a sudden rope breakage caused by the long-term wear and friction between the pulling rope and the fixing device.

To achieve the foregoing objective, the present invention provides a pulling rope fixing structure, comprising: a handle, being a hollow tubular body; a grip rope, passed through and installed in the handle, and having a first end and a second end, and a first opening and a second opening formed at the first end and the second end respectively; a fixing device, including a retaining ring and a fastening element, and the fastening element having a hollow sleeve passed through and installed in the first opening and the second opening, and provided for pressing the retaining ring thereon to superimpose and fix the first end with the second end; an elastic element, made of rubber, and installed in the hollow sleeve, and having a penetrating hole, wherein the elastic element has a first protrusion and a second protrusion abutted against the fixing device to prevent the elastic element from being loosened or falling out; and a pulling rope, passed through and installed in the penetrating hole, and having a position limiting element disposed at an end of the pulling rope, for abutting the pulling rope against the elastic element and preventing the pulling rope from falling out from the penetrating hole, wherein the positioning limiting element has a diameter greater than the diameter of the penetrating hole, and the pulling rope is a hollow elastic pulling rope.

Wherein, the retaining ring has a bump disposed around a surface of the retaining ring, such that when the retaining ring and the fastening element are installed, an outer wall of the hollow sleeve is latched to an inner edge of the bump.

Wherein, the grip rope has a joint portion including a first side and a second side, and the first side is coupled to a section of a rope body of the grip rope extended out from openings at both ends of the handle, and the second side is coupled to the first end and the second end of the grip rope.

In an embodiment, the first protrusion and the second protrusion are ring structures.

In an embodiment, the first protrusion and the second protrusion include a plurality of vertical columns.

DETAILED DESCRIPTION OF THE PREFERRED EMBODIMENTS

The technical contents of the present invention will become apparent with the detailed description of preferred embodiments and the illustration of related drawings as follows.

Figure 1:
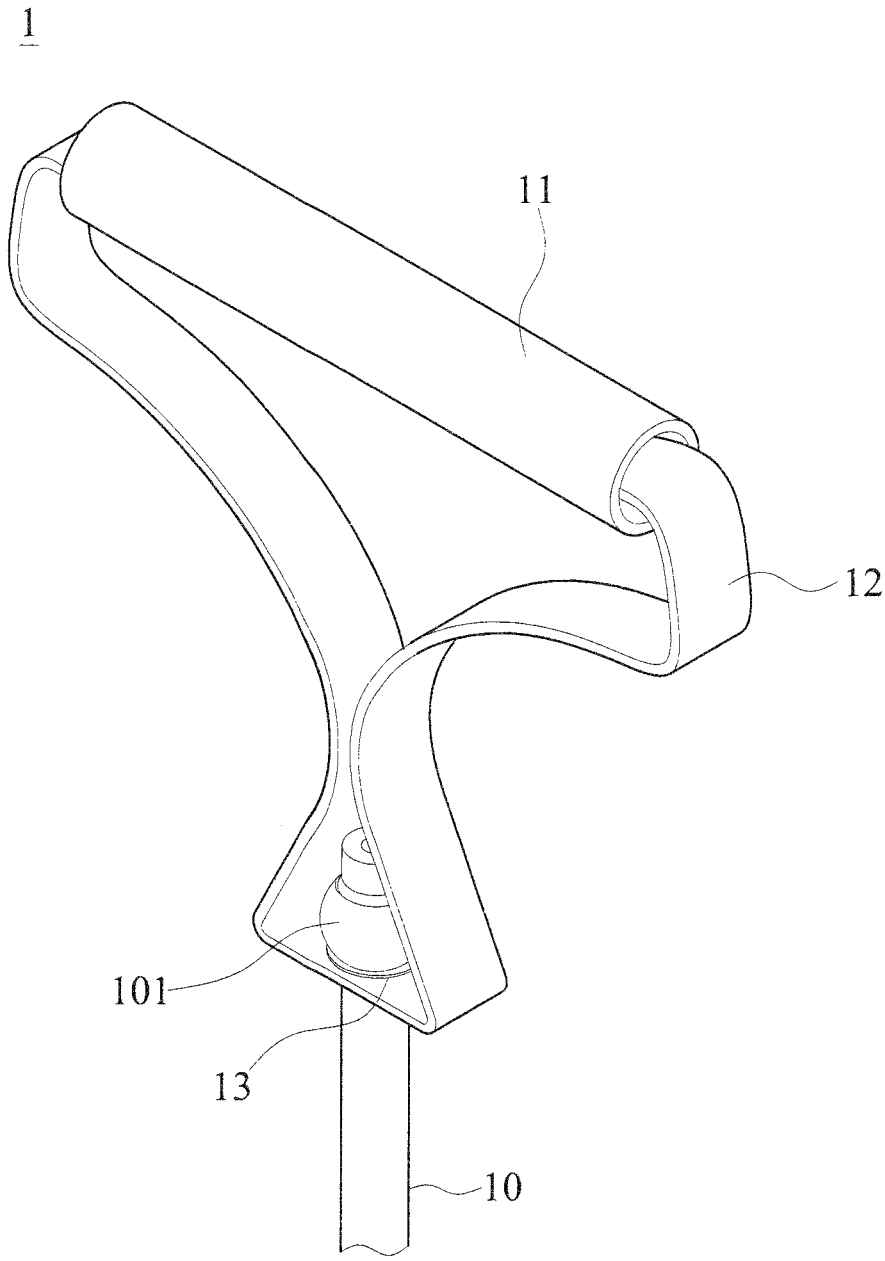
Fig. 1(PRIOR ART)
FIG. 1 is a schematic view of a conventional elastic fitness device.
Figure 2:
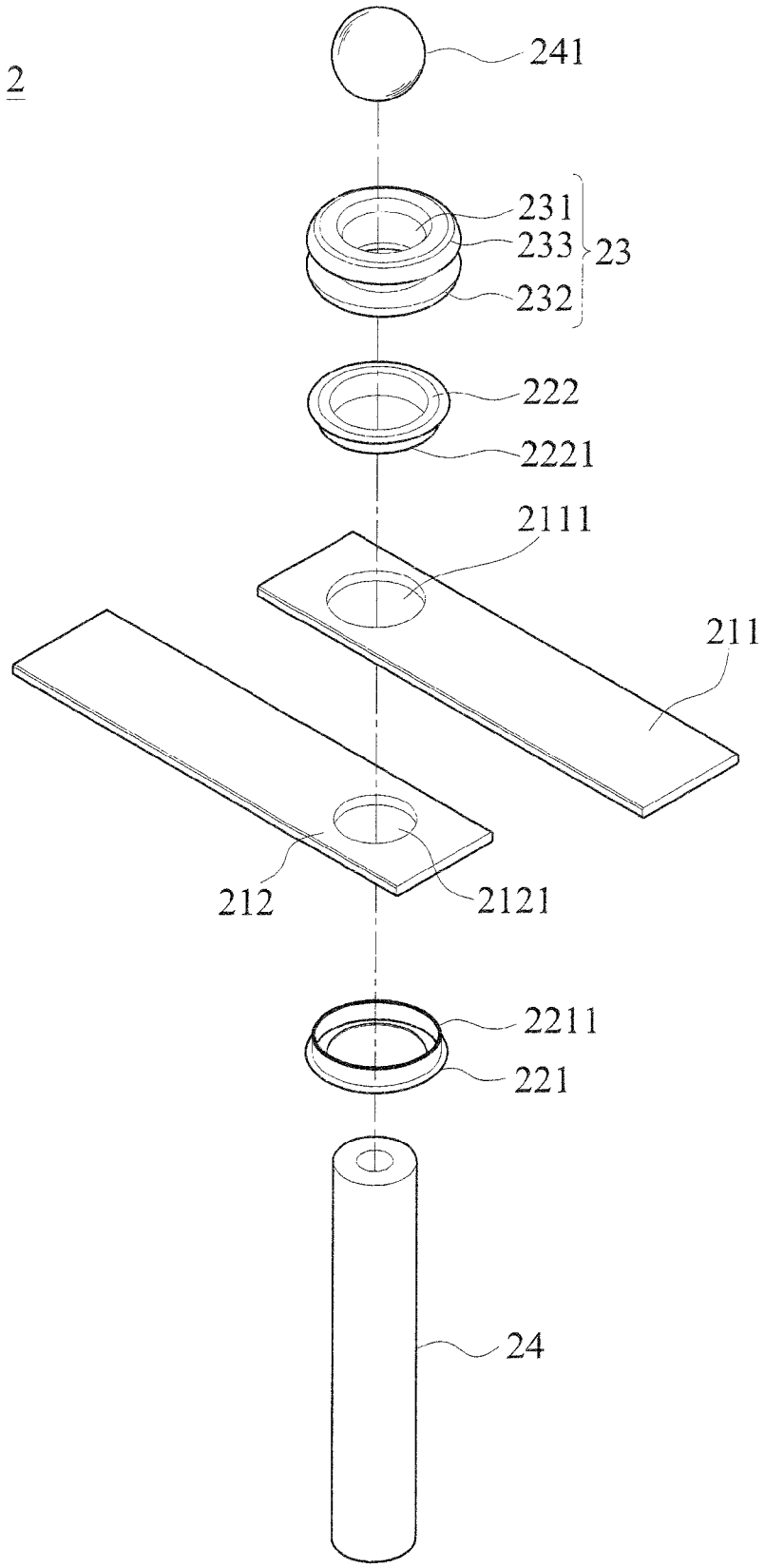
FIG. 2 is an exploded view of a first implementation in accordance with a preferred embodiment of the present invention.
Figure 3:
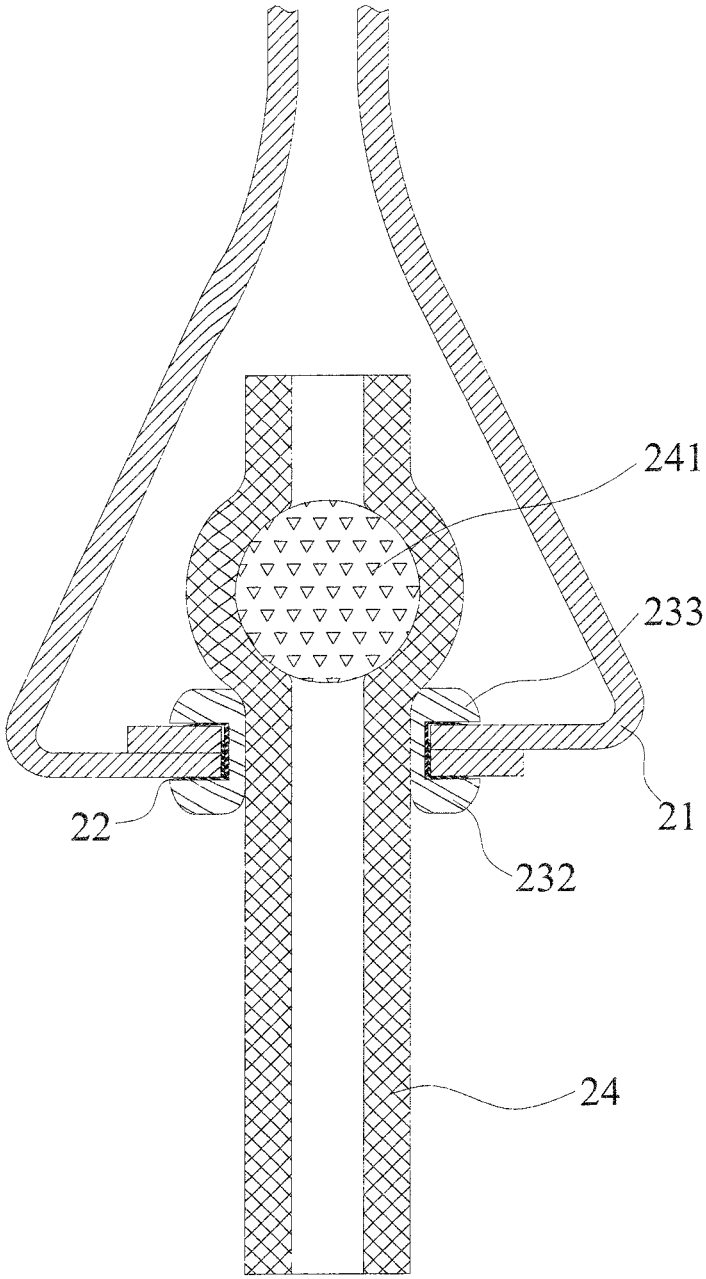
FIG. 3 is a cross-sectional view of a first implementation in accordance with a preferred embodiment of the present invention.
Figure 4:
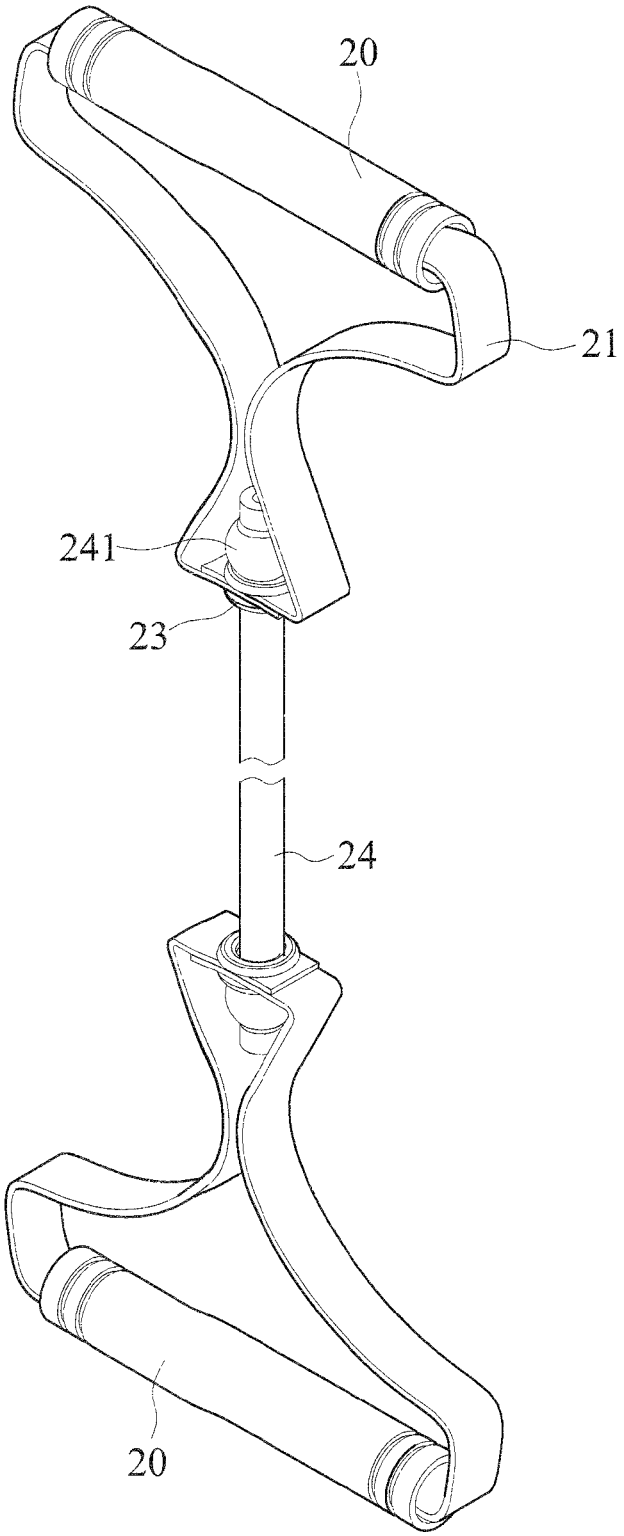
FIG. 4 is a perspective view of a first implementation in accordance with a preferred embodiment of the present invention.

With reference to FIGS. 2, 3 and 4 for an exploded view, a cross-sectional view and a perspective view of the first implementation of a pulling rope fixing structure in accordance with a preferred embodiment of the present invention respectively, the pulling rope fixing structure 2 comprises a handle 20, a grip rope 21, a fixing device 22, an elastic element 23 and a pulling rope 24.

The handle 20 is a hollow tubular body provided for a user to grip, wherein the handle 20 includes a soft cover (not shown in the figure) disposed on an outer surface of the handle 20, so that the user can hold the handle 20 with the comfortable and anti-slip effects.

The grip rope 21 is a planar strip made of cloth and passed through and installed in the handle 20 for combining the pulling rope 24 with the handle 20. The grip rope 21 has a first end 211 and a second end 212, and the first end 211 and the second end 212 have a first opening 2111 and a second opening 2121 respectively.

The fixing device 22 includes a retaining ring 221 and a fastening element 222, wherein the retaining ring 221 and the fastening element 222 are made of metal to enhance the fixing force and extend the service life. The fastening element 222 includes a hollow sleeve 2221 sheathed into the first opening 2111 and the second opening 2121, wherein a bump 2211 is formed on a surface of the retaining ring 221 and disposed at a distance from the center hole of the retaining ring 221. After the first end 211 and the second end 212 of the grip rope 21 are superimposed with each other, the hollow sleeve 2221 is passed into the first opening 2111 and the second opening 2121, and the retaining ring 221 is pressed onto the hollow sleeve 2221, such that an outer wall of the hollow sleeve 2221 is latched with an inner wall of the bump 2211 to fix and combine the first end 211 and the second end 212 of the grip rope 21 with each other.

The elastic element 23 is made of a durable elastic material such as rubber and installed in the hollow sleeve 2221. The elastic element 23 has a penetrating hole 231 for passing the pulling rope 24 to prevent the pulling rope 24 from being contacted with the fixing device 22 directly, so as to prevent the pulling rope 24 from being damaged, worn or broken by external forces and reduce the depletion rate of the pulling rope 24. Wherein, the elastic element 23 includes a first protrusion 232 and a second protrusion 233, and the first protrusion 232 and the second protrusion 233 are ring structures with a size greater than the fastening element 222 and the retaining ring 221, so that the first protrusion 232 and the second protrusion 233 can abut the fastening element 222 and the retaining ring 221 respectively to prevent the elastic element 23 from being separated from the hollow sleeve 2221, and the first protrusion 232 and the second protrusion 233 also can be covered onto the fastening element 222 and the retaining ring 221 to achieve the effect of protecting the fastening element 222 and the retaining ring 221.

The pulling rope 24 is passed into the penetrating hole 231 and includes a position limiting element 241 installed at an end of the pulling rope 24, such that the pulling rope 24 and the elastic element 23 are abutted with each other, and the pulling rope 24 can be an elastic rope body. In this preferred embodiment, the pulling rope 24 is an elastic hollow pulling rope. Wherein, an end of the pulling rope 24 passing through the penetrating hole 231 is plugged with the position limiting element 241, and the position limiting element 241 is a sphere. Since the position limiting element 241 has a diameter greater than the diameter of the penetrating hole 231, therefore the pulling rope 24 can abut against the penetrating hole 231 without falling out from the penetrating hole 231, so as to prevent users from being injured by a loosened pulling rope 24 during exercise.

Figure 5:
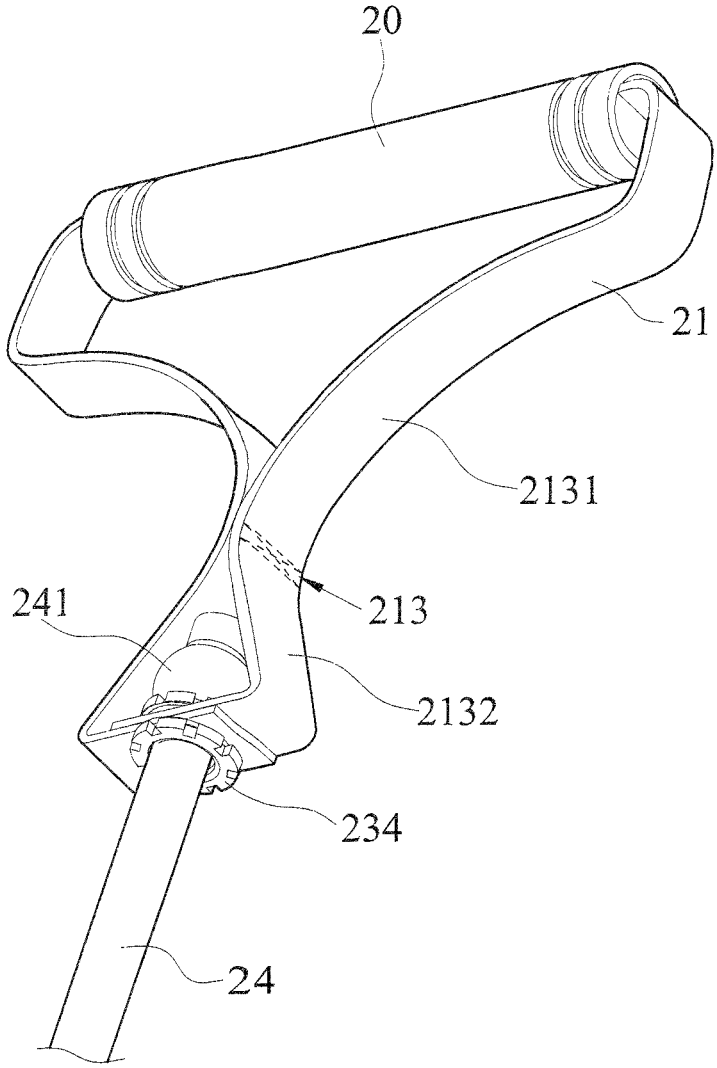
FIG. 5 is a perspective view of a second implementation in accordance with a preferred embodiment of the present invention.

With reference to FIG. 5 for a perspective view of a second implementation in accordance with a preferred embodiment of the present invention, the grip rope 21 has a joint portion 213 including a first side 2131 and a second side 2132, and the first side 2131 is coupled to a section of a rope body of the grip rope 21 extended from openings at both ends of the handle 20, and the second side 2132 is coupled to the first end 211 and the second end 212 of the grip rope 21.

The first protrusion 232 and the second protrusion 233 of the elastic element 23 include a plurality of vertical columns 234 arranged equidistantly from one another, so that the elastic element 23 can abut the fastening element 222 and the retaining ring 221 without being separated from the hollow sleeve 2221, so as to provide another different stylish appearance.

The pulling rope fixing structure 2 of the present invention effectively separates the pulling rope 24 from the metal fixing device 22 by the elastic element 23, so that the pulling rope 24 will not be rubbed, worn or broken by the fixing device 22 during exercise, so as to achieve the effects of protecting the pulling rope 24, extending the service life of the pulling rope 24, and preventing the users from being injured by a fatigue-wear pulling rope 24 or a cut by a sharp edge of the pulling rope 24.

What is claimed is:

1. A pulling rope fixing structure, comprising:

a handle, being a hollow tubular body;

a grip rope, installed in the handle, and having a first end and a second end, and a first opening and a second opening formed at the first end and the second end respectively;

a fixing device, including a retaining ring and a fastening element, and the fastening element having a hollow sleeve passed through and installed in the first opening and the second opening, and provided for pressing the retaining ring thereon to superimpose and fix the first end with the second end;

an elastic element, installed in the hollow sleeve, and having a penetrating hole; and a pulling rope, passed through and installed in the penetrating hole, and having a position limiting element disposed at an end of the pulling rope, for abutting the pulling rope against the elastic element and preventing the pulling rope from falling out from the penetrating hole.

2. The pulling rope fixing structure of claim 1, wherein the elastic element includes a first protrusion and a second protrusion, abutted against the fixing device to prevent the elastic element from being loosened or falling out.

3. The pulling rope fixing structure of claim 2, wherein the first protrusion and the second protrusion are ring structures.

4. The pulling rope fixing structure of claim 2, wherein the first protrusion and the second protrusion include a plurality of vertical columns.

5. The pulling rope fixing structure of claim 2, wherein the elastic element is made of rubber.

6. The pulling rope fixing structure of claim 1, wherein the elastic element is made of rubber.

7. The pulling rope fixing structure of claim 1, wherein the retaining ring has a bump disposed around a surface of the retaining ring, such that when the retaining ring and the fastening element are installed, an outer wall of the hollow sleeve is latched to an inner edge of the bump.

8. The pulling rope fixing structure of claim 1, wherein the pulling rope is a hollow elastic pulling rope.

9. The pulling rope fixing structure of claim 1, wherein the position limiting element is a sphere having a diameter greater than the diameter of the penetrating hole.

10. The pulling rope fixing structure of claim 1, wherein the grip rope has a joint portion including a first side and a second side, and the first side is coupled to a section of a rope body of the grip rope extended out from openings at both ends of the handle, and the second side is coupled to the first end and the second end of the grip rope.

* * * * *